United States Patent [19]

Hellstrom

[11] Patent Number: 4,819,988

[45] Date of Patent: Apr. 11, 1989

[54] RESTRAINING DEVICE FOR A CHAIR

[76] Inventor: Thomas Hellstrom, 30018 Manhattan, St. Clair Shores, Mich. 48082

[21] Appl. No.: 68,927

[22] Filed: Jul. 1, 1987

[51] Int. Cl.[4] ..... A47C 31/00

[52] U.S. Cl. ..... 297/467; 297/427

[58] Field of Search ..... 297/467, 466, 427, 423; 248/408, 409

[56] References Cited

U.S. PATENT DOCUMENTS

| | | | |
|---|---|---|---|
| 1,259,604 | 3/1918 | Cook | 297/467 |
| 1,902,367 | 3/1933 | Johnson | 297/467 |
| 2,084,448 | 6/1937 | Merchant | 297/466 |
| 2,858,882 | 11/1958 | Personett | 297/467 |
| 3,409,326 | 11/1986 | Kerner | 28/753 |
| 3,717,375 | 2/1973 | Slobodan | 297/174 X |
| 3,767,259 | 10/1973 | Blake et al. | 297/250 |
| 3,788,699 | 1/1974 | Starr | 297/153 X |
| 3,918,760 | 11/1975 | Goldberg | 297/488 |
| 4,143,915 | 3/1979 | Kamlay | 297/216 X |
| 4,422,658 | 12/1983 | Hilliard | 297/467 X |

FOREIGN PATENT DOCUMENTS

| | | | |
|---|---|---|---|
| 257406 | 9/1926 | United Kingdom | 248/408 |

*Primary Examiner*—James T. McCall

*Attorney, Agent, or Firm*—Brooks & Kushman

[57] ABSTRACT

A restraining device for highchairs and the like comprises limb means for closely overlying the lap of an occupant of the chair and adjustable vertically and horizontally with respect to the chair. The device includes a post which is attached in one embodiment to the underside of the feeding tray and in another embodiment to the seat of the chair.

11 Claims, 2 Drawing Sheets

FIG.6
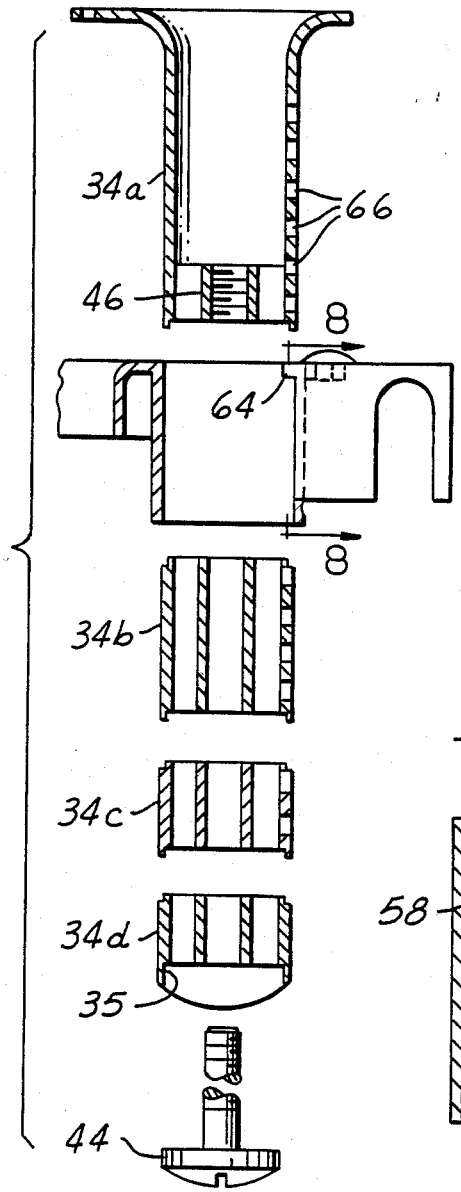
FIG.7
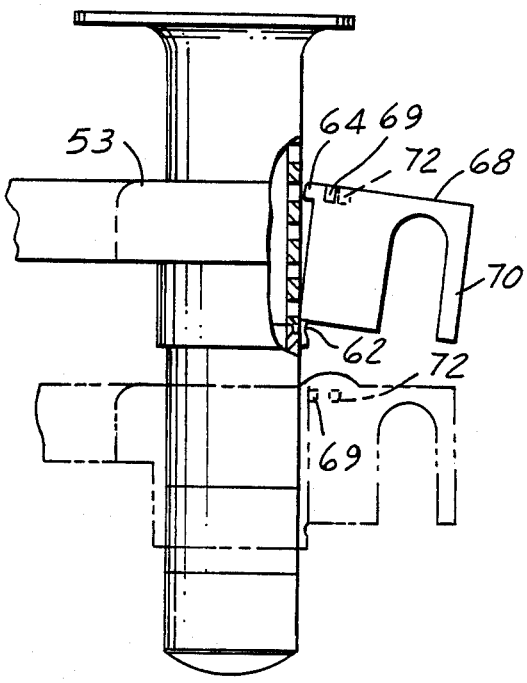
FIG.8
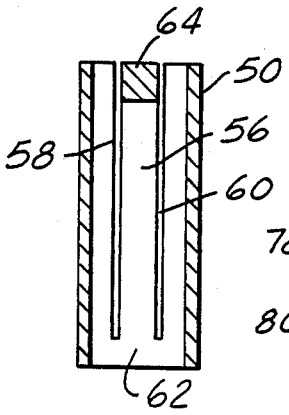
FIG.9
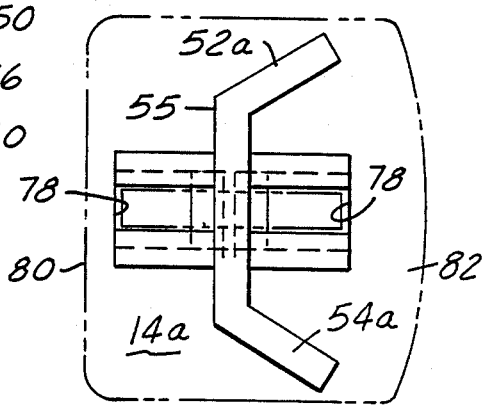
FIG.10
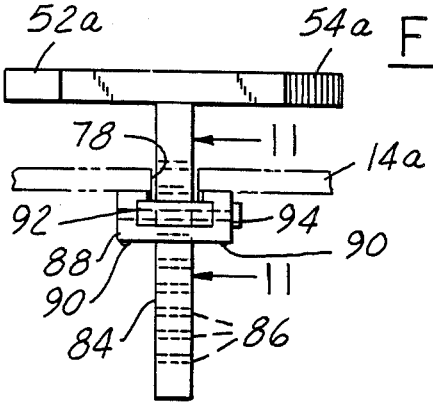
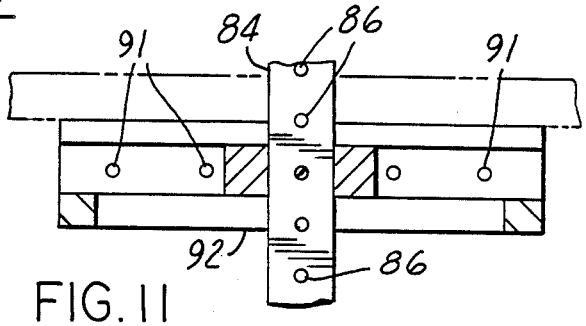
FIG.11

RESTRAINING DEVICE FOR A CHAIR

DESCRIPTION

1. Field of Invention

This invention relates to restraining devices for highchairs and the like.

2. Background of Invention

Various devices have been suggested heretofore to restrain occupants of chairs so that they cannot leave the chair without being released. Examples of such devices are shown in U.S. Pat. Nos. 3,409,326; 3,767,259; 3,788,699; 3,918,760 and 4,143,915. Such devices are often cumbersome to use and when involving straps and ties require the threading of buckles and the like and are subject to being undone by the chair's occupant. I believe a need exists for a simple and foolproof restraint for highchairs and the like which may be readily installed as a retrofit to existing highchairs or may be mounted as original equipment on newly manufactured chairs.

SUMMARY OF THE INVENTION

In a conventional highchair having a seat, back, arms and a tray removably secured thereto and extending across the front of an occupant of the chair, my invention is characterized by a post disposed midway between the arms and extending generally vertically between the seat and tray and secured to one of them. Generally U-shaped limb means are mounted on the post to overlie the lap of the chair's occupant. The limbs extend angularly toward the arms and also toward the back of the chair and when adjusted to closely overlie the thighs of the occupant will prevent escape from the chair. Two embodiments are disclosed, one in which the restraining device is mounted to the underside of the feeding tray and the other in which the restraining device is mounted to the seat of the chair.

BRIEF DESCRIPTION OF THE DRAWINGS

FIG. 6 is an exploded view of the post means;

FIG. 7 is an elevational view showing the post and the adjustability of the limb means thereon with parts broken away for clarity;

FIG. 8 is a cross-sectional view taken on the line 8—8 of FIG. 7;

FIG. 9 is a top elevation with the serving tray removed for clarity of a modified form of my restraining device;

FIG. 10 is a front elevation of the modified restraining device of FIG. 9;

FIG. 11 is a cross-sectional view taken on the line 11—11 of FIG. 10.

BRIEF DESCRIPTION OF THE PREFERRED EMBODIMENTS

Figure 1:
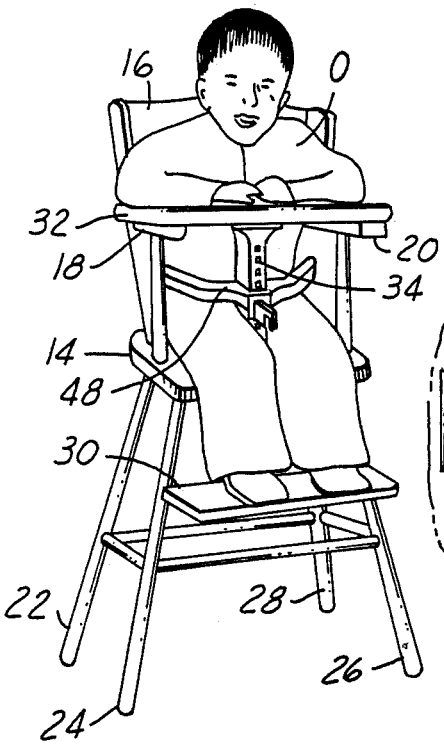
FIG. 1 is a perspective view of one embodiment of my invention mounted on a highchair.

As shown in FIG. 1, my invention comprises a restraint device particularly suitable for use with conventional highchairs though, as will be apparent from the following description, the principles of design and operation will be equally applicable to adult chairs, such as chairs for the elderly or adults requiring restraint in a chair. The chair itself, which is conventional, comprises a seat portion 14, a back portion 16, arms 18 and 20, legs 22, 24, 26 and 28, a foot rest 30 and feeding tray 32. The tray is conventionally removably attached to the arms by means not shown so that the tray may be removed from or locked on the arms. Normally the locking of the tray on the arm is of such a character as to permit adjustment of the tray toward and away from the back 16 to accommodate varying size children. My invention is intended to prevent an occupant O of the chair from escaping therefrom without the parent or guardian's permission, and yet permit the occupant substantial freedom of movement in the chair.

Figure 4:
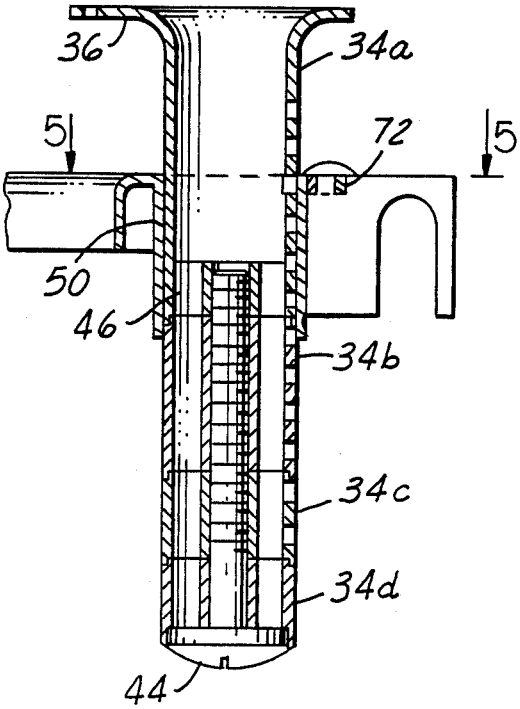
FIG. 4 is a cross-sectional view taken on the line 4—4 of FIG. 3.
Figure 5:
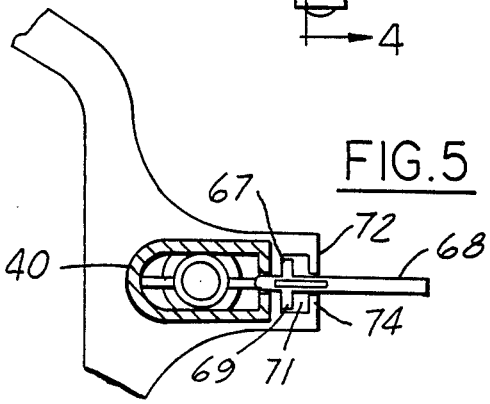
FIG. 5 is a cross-sectional view taken on the line 5—5 of FIG. 4.

In the preferred embodiment of the invention, post means 34 extend between the seat 14 and the tray 32, being disposed midway between the arms 18 and 20 such that the occupant's legs may straddle the post. The post is attached to the underside of the tray. For this purpose the upper end of the post includes a laterally extending flange 36 through which fasteners 38 are extended into the tray to secure the post thereto. The post itself is hollow and may be formed of metal or plastic, but in the embodiment shown is formed of plastic and is of rectangular cross-section as best shown in FIG. 5, with the wall portion 40 facing the crotch of the occupant being smoothly rounded.

Where the restraint device is to be retrofitted on existing highchairs, the post may be formed of a series of end abutting interfitting post sections 34*a*, 34*b*, 34*c*, and 34*d* held together as shown in FIG. 4 by an elongated bolt 42 having a head 44 which is received in the counterbore end 35 of the section 34*d* (or whichever section is lower most) with the opposite end threaded into a nut 46 fixed within section 34*a*. By inserting or removing post sections, the post may be adapted to any particular highchair so that it will extend substantially from the seat 14 to the tray 32 or vice versa.

Figure 2:
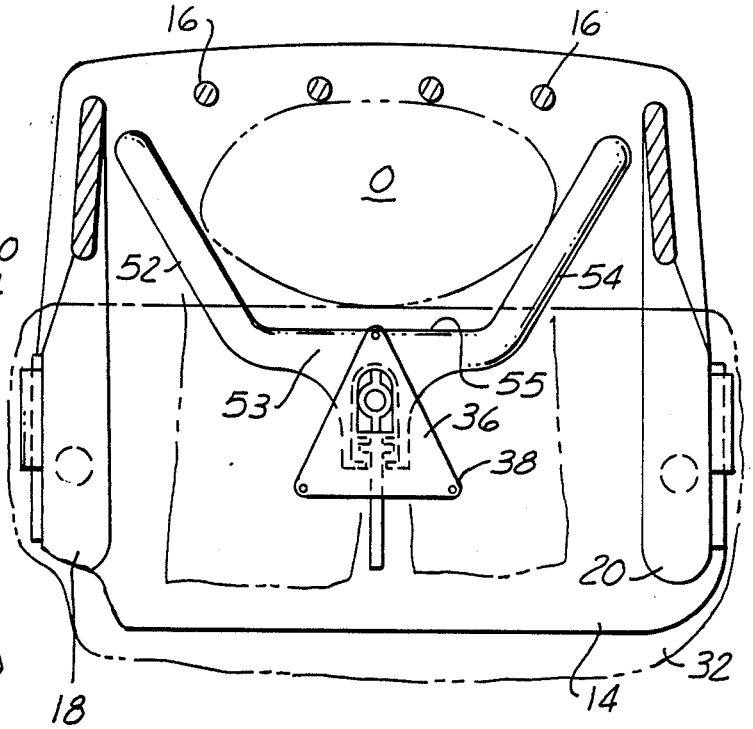
FIG. 2 is a cross-sectional view through the chair of FIG. 1 looking down toward the seat portion taken just below the feeding tray but with the tray shown in phantom outline for reference purposes.

Mounted on the post means 34 is limb means 48 of generally U-shaped configuration intended to overlie the lap of the occupant of the chair and prevent the unwanted escape from the chair. The limb means comprises a sleeve portion 50 which telescopes over the post 34 and a pair of limbs 52 and 54 integral with the sleeve portion and extending as best shown in FIGS. 1 and 2 toward the arms and back of the chair to overlie the thighs and partially encircle the torso of the occupant. The angle between the limbs 52 and 54 may be on the order to 60°. As shown in FIG. 2, the limbs cooperate with the back 16 to substantially encircle the torso of the occupant. By positioning the limbs close to the thighs, (or lap) the occuant cannot, by wiggling or squirming, free themself from the chair and must remain therein until released, as by removal of the tray 32 therefrom. The limbs are sufficiently rigid so that the occupant cannot flex them sufficiently to escape from the chair.

The limb means includes a central portion 53 which extends between the limbs 52 and 54 and is integral with the sleeve portion 50. This central portion has an edge or surface 55 that is spaced toward the back 16 of the chair from the post means 34 such that with the occupant sitting upright in the chair, the edge 55 will engage the occupant at the stomach before the crotch engages the post means. Thus the device, as a side benefit, promotes good posture in the chair.

The limb means 48 may be formed of metal or plastic, but in the preferred embodiment is molded of plastic, such as high impact polyproplyene, with the limbs 52 and 54 of generally rectangular shape in cross-section. The limbs are locked in vertically adjustable positions on the post 34 by a spring loaded detent comprising an elongated tongue 56 best shown in FIGS. 7, 8 and 9. The tongue is formed by a pair of slits 58 and 60 extending downwardly through a wall of the sleeve portion and terminating spaced upwardly from the bottom edge. The resiliency of the plastic material of which the limbs are formed will effect a resilient hinge between the tongue and sleeve in the area 62 shown in FIG. 8.

Figure 3:
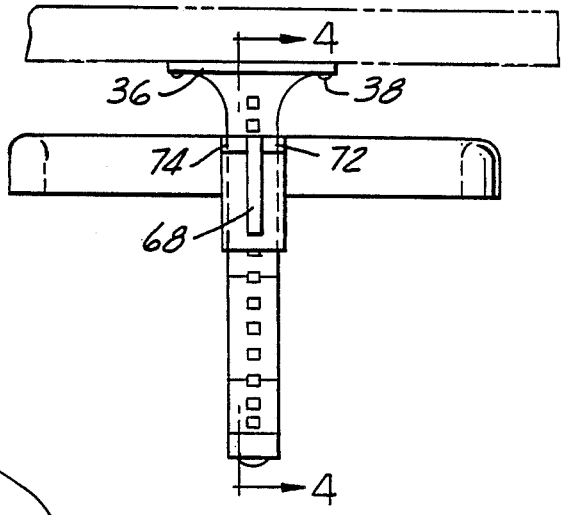
FIG. 3 is a front view of the restraining device shown in FIG. 1.

At the opposite end of the tongue from the resilient hinge 62, the tongue is provided with a catch portion 64 in the form of a short projection adapted to enter any one of a series of vertically spaced aperture 66 in the confronting wall of the post 34. The tongue is further provided with an integral handle 68 having a finger grasping portion 70. To limit the outward flexing of the tongue and guide it so the catch will enter the apertures 66, the sleeve is provided as best shown in FIGS. 3 and 5 with an integral channel shaped projection at the upper end of the sleeve providing stop fingers 72 and 74. The handle has two lateral projections 67 and 69 which are disposed in the channel 71 and act as guides during movement of the handle to limit flexture thereof.

Thus the limbs means 48 may be adjusted vertically between the seat 14 and feeding tray 32 to closely overlie the lap of the occupant and restrain the same from leaving the chair until the tray is removed. By adjusting the position of the tray toward and away from the back 16, the limb means may be adjusted closer to or farther from the torso of the occupant.

In the modification of the restraint shown in Figs. 9-11, the post means is mounted on the seat 14 rather than the tray 32 and the limb means is fixed to the post. The post may be shifted vertically to adjust the position of the limbs above the occupant's lap and the post may also be adjusted horizontally toward and from the back 16. In this modification the seat **14*a* (corresponding to the seat 14 shown in FIG. 1) is provided with a through slot 78 extending in a direction between the front edge 80 and the rear edge 82 of the seat. Post means 84 extends through the slot and is provided at its upper end with generally U-shaped limb means having limb portions 52*a* and 54*a* at opposite ends of a central portion 55 connected to the post. The post has a series of vertically spaced apart apertures 86**.

To lock the post and in turn the limb means in vertically and horizontally adjusted positions, a generally C-shaped channel 88 is provided which is mounted to the underside of the seat **14*a* as shown in FIGS. 10 and 11 by suitable fasteners 90. The channel opens upwardly through its open side into the slot 78 while its opposite wall is cut away through a portion of its length to allow the post to project downwardly as shown in FIG. 10. Side walls of the channel are provided with an opposed spaced apart series of apertures 91. The post is carried in the channel by a slider 92 having a transverse pin 94 which cooperates with the apertures 86 and 91** to permit adjustable positioning of the post in horizontally and vertically selected positions whereby the position of the limbs may be suited to the size of the occupant of the chair to restrain the same against unintended escape therefrom.

Thus it will be noted that I have provided a restraining device for occupants of a chair that utilizes a limb arrangement overlying the lap of the chair's occupant and which may be adjusted horizontally and vertically to suit the size of the occupant. The restraining device may be mounted either to the tray or to the seat and may be provided as a retrofit to existing chairs or as a restraint for original equipment manufacture.

What is claimed is:

1. In a device for restraining an occupant of a chair having a seat, arms, and a tray extending across the front of the occupant, the invention characterized by:

post means disposed midway between the arms and extending generally vertically between the seat and tray and secured to one of them;

thigh engaging limb means mounted on the post means for vertically adjustable positioning and extending laterally thereof toward the arms to overlie in juxtaposition the thighs of an occupant and prevent escape from the chair; and detent means for locking the limb means in vertically adjusted positions to adapt the limb means to the thighs of the occupant to be restrained.

2. The invention defined by claim 1 wherein said limb means is generally U-shaped to overlie the thighs of an occupant and partially embrace the torso.

3. The invention defined by claim 1 wherein said detent means comprising an elongated tongue resiliently connected at one end to the sleeve and having a catch portion at the opposite end for entering any one of a series of apertures in the post means.

4. The invention defined in claim 3 wherein said sleeve is formed of plastic material and said detent means comprises an elongated tongue integrally resiliently connected with the sleeve at one end and having a catch portion at the opposite end for locking engagement with the post means.

5. The invention defined by claim 3 wherein said tongue includes a handle portion to facilitate manual deflection of the tongue to disengage the catch from the post to permit adjustment between the post and sleeve.

6. The invention defined by claim 1 wherein said post means comprising a plurality of end connected post sections whereby removal or addition of sections permit elongation or shortening of the post means to accommodate varying distances between the seat and tray.

7. The invention defined by claim 6 wherein said post means is hollow and the post sections are shaped to interfit at their meeting ends, and fastener means extends axially through the post sections to secure them in rigid connected relation.

8. The invention defined by claim 1 wherein said post means is adjustable toward and away from an occupant of the chair.

9. The invention defined by claim 1 wherein said post is mounted on the seat.

10. The invention defined by claim 9 wherein the limb means is fixedly connected to the post and the post is vertically adjustable on the seat.

11. The invention defined in claim 1 wherein said limb means is sufficiently rigid to prevent flexure thereof and escape of an occupant of the chair.

* * * * *